US005323745A

United States Patent [19]

Sato et al.

[11] Patent Number: 5,323,745

[45] Date of Patent: Jun. 28, 1994

[54] PLASTIC ROCKER COVER

[75] Inventors: Hideaki Sato, Hidaka; Hajime Kawabata, Kokubunj, both of Japan

[73] Assignee: Tsuchiya Mfg. Co., Ltd., Tokyo, Japan

[21] Appl. No.: 37,130

[22] Filed: Mar. 25, 1993

[30] Foreign Application Priority Data

Mar. 26, 1992 [JP] Japan ..... 4-024889
Feb. 17, 1993 [JP] Japan ..... 5-10287

[51] Int. Cl.[5] ..... F02B 77/00
[52] U.S. Cl. ..... 123/195 C; 123/90.38
[58] Field of Search ..... 123/195 C, 90, 38, 572, 123/573, 41.86

[56] References Cited

U.S. PATENT DOCUMENTS 4,993,375 2/1991 Akihiko ..... 123/90.38
5,129,371 7/1992 Rosalik, Jr. ..... 123/90.38
5,228,420 7/1993 Furuya ..... 123/90.38

*Primary Examiner*—Noah P. Kamen
*Attorney, Agent, or Firm*—Foley & Lardner

[57] ABSTRACT

An outer cover member of a plastic rocker cover has a top wall, a peripheral wall and a partition wall cooperating with the top wall and the peripheral wall to define therebetween an oil-gas separating chamber. The peripheral wall has a plurality of flanged portions at which the rocker cover is to be bolted to a cylinder head. The outer cover member further has a plurality of resiliently deformable buffer walls integral with a top wall of the outer cover member and depending therefrom so as to be spaced inward from the flanged peripheral wall portions. The partition member is secured to lower ends of the buffer walls so that oil-gas separating chamber is partly defined by the buffer walls. The buffer walls are resiliently deformable to absorb thermal expansion and contraction of the partition member.

6 Claims, 3 Drawing Sheets

PLASTIC ROCKER COVER

BACKGROUND OF THE INVENTION

Field of the Invention

The present invention relates in general to internal combustion engines and more particularly to a plastic cylinder head cover or rocker cover for an internal combustion engine.

Disclosure Information

A rocker cover made of a synthetic resinous material such as nylon has been used in an internal combustion engine with a view to reducing the weight. Such a plastic rocker cover mainly consists of an outer cover member and an inner partition member which cooperate to define therebetween an oil-gas separating chamber. The cover member and the partition member have barrier like projections forming within the oil-gas separating chamber a zig-zag blow-by passage leading to an intake manifold of the engine. On an intake stroke, blow-by gases in the crankcase are drawn by vacuum into the oil-gas separating chamber where oil is separated from the blow-by gases and then supplied to the intake manifold. The partition member is secured at its entire outer periphery directly to the peripheral wall of the cover member by, for example, heat bonding.

A problem of the prior art plastic rocker cover is that the outer cover member is liable to be deformed or distorted at a high temperature or low temperature, and in the worst case it is liable to crack at some peripheral wall portions where it is connected with the partition member. In the case where the outer cover member is given a sufficiently large rigidity, the inner partition wall member itself becomes susceptible to damage.

As a result of experiments conducted by the applicants, it found that such deformation or damage to the outer cover member was resulted from a combination of the difference in thermal expansion and contraction between the outer cover member and the inner partition member and the stresses in the bolted portions of the outer cover member. It further found that such deformation or damage of the outer cover member was resulted from the difference in deformation between the outer cover member and the inner partition member due to crystallization of the synthetic resinous material forming the outer cover member and the inner partition member.

SUMMARY OF THE INVENTION

According to an aspect of the present invention, there is provided a plastic rocker cover which comprises an outer cover member made of a synthetic resinous material and having a top wall, a peripheral wall and a buffer wall disposed inside of the peripheral wall and depending from the top wall, and an inner partition member made of a synthetic resinous material and secured to a lower end of the buffer wall to define an oil gas separating chamber enclosed by the top wall, the buffer wall and the partition member, the buffer wall being resiliently deformable to absorb expansion and contraction of the partition member.

According to another aspect of the present invention, there is provided a plastic rocker cover which comprises a box-like outer cover member made of a synthetic resinous material and having a top wall formed with a blow by gas outlet, a peripheral wall and a buffer wall depending from the top wall in such a manner as to be spaced inward from the peripheral wall, and an inner partition member made of a synthetic resinous material, secured to a lower end of the buffer wall and cooperating with the buffer wall and the top wall to define an oil-gas separating chamber, the inner partition member having a blow by gas inlet and a drain opening so that blow-by gases are drawn to flow through the blow-by gas inlet, the oil-gas separating chamber and the blow-by gas outlet whilst oil separated from blow-by gases in the oil gas separating chamber is drained through the drain opening, the buffer wall being resiliently deformable to absorb expansion and contraction of the partition member.

According to a further aspect of the present invention, there is provided a plastic rocker cover which comprises a box-like outer cover member made of a synthetic resinous material and having a top wall formed with a blow-by gas outlet, a peripheral wall and a buffer wall in the form of a rectangular ring or tube depending from the top wall in such a manner as to be spaced inward from the peripheral wall, an inner partition member made of a synthetic resinous material, secured to a lower end of the buffer wall and cooperating with the buffer wall and the top wall to define an oil-gas separating chamber where oil is separated from blow by gases drawn to flow through the oil-gas separating chamber, the inner partition member having a blow-by gas inlet and a drain opening so that blow by gases are drawn to flow through the blow-by inlet, the oil-gas separating chamber and the blow-by gas outlet whilst oil separated from blow by gases in the oil-gas separating chamber is drained through the drain opening, the top wall of the outer cover member and the partition wall member having downward and upward barrier-like projections forming within the oil-gas separating chamber a zig-zag blow-by gas passage for promoting separation of oil from blow-by gases, the buffer wall being resiliently deformable to absorb thermal expansion and contraction of the partition wall member.

According to a further aspect of the present invention, there is provided a plastic rocker cover which comprises an outer cover member made of a synthetic resinous material and having a top wall and a peripheral wall, an inner partition member made of a synthetic resinous material and disposed inside of the outer cover member to cooperate with the top wall and the peripheral wall to define therebetween an oil-gas separating chamber, the peripheral wall of the outer cover member having flanged portions at which it is to be bolted, and buffer wall means for absorbing expansion and contraction of the partition member whilst defining part of the oil-gas separating chamber, the buffer wall means including resiliently deformable buffer walls integral with the top wall and depending therefrom in such a manner as to be spaced inward from the flanged peripheral wall portions, the partition member being secured to lower ends of the buffer walls.

The above structure is effective for solving the above noted problem inherent in the prior art device.

It is accordingly an object of the present invention to provide an improved plastic rocker cover which can assuredly prevent its outer cover member or partition member from being damaged due to thermal expansion and contraction of its inner partition wall member or due to the difference in deformation caused by crystallization of the synthetic resinous material forming the outer cover member and the inner partition member.

It is a further object of the present invention to provide an improved plastic rocker cover which is durable for an elongated period of usage.

BRIEF DESCRIPTION OF THE INVENTION

DETAILED DESCRIPTION OF THE PREFERRED EMBODIMENT

Figure 1:
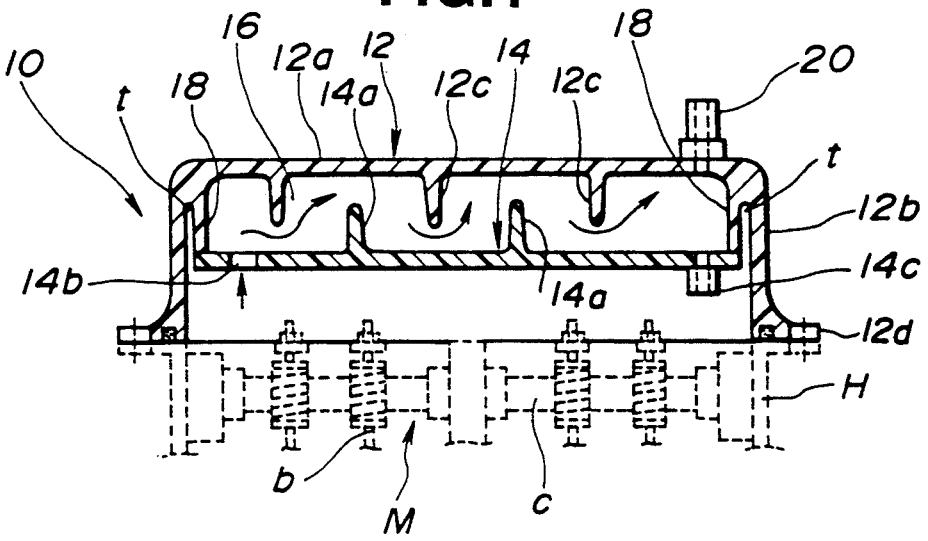
FIG. 1 is a longitudinal sectional view of a rocker cover according to an embodiment of the present invention, together with a schematic view of a cylinder head and a valve operating mechanism of an internal combustion engine.
Figure 2:
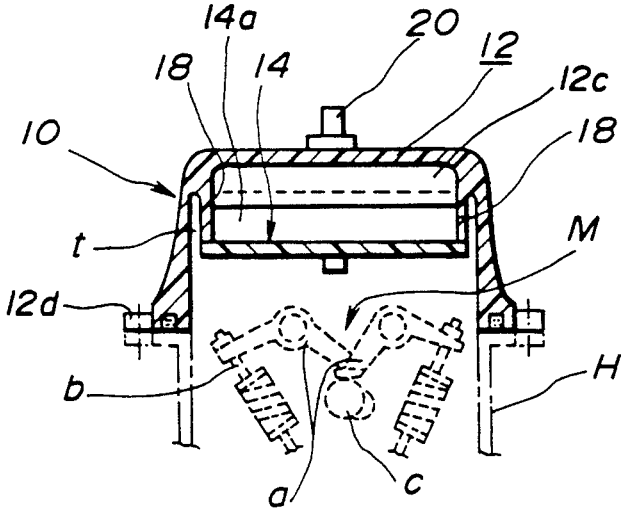
FIG. 2 is a cross sectional view of the rocker cover of FIG. 1.
Figure 3:
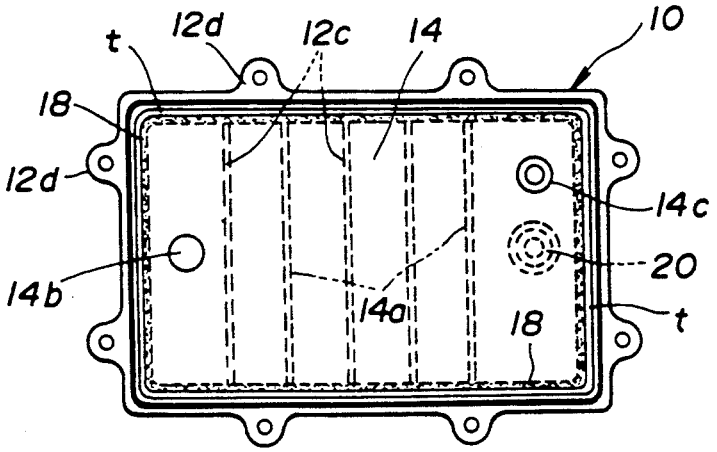
FIG. 3 is a bottom plan view of the rocker cover of FIG. 1.
Figure 4:
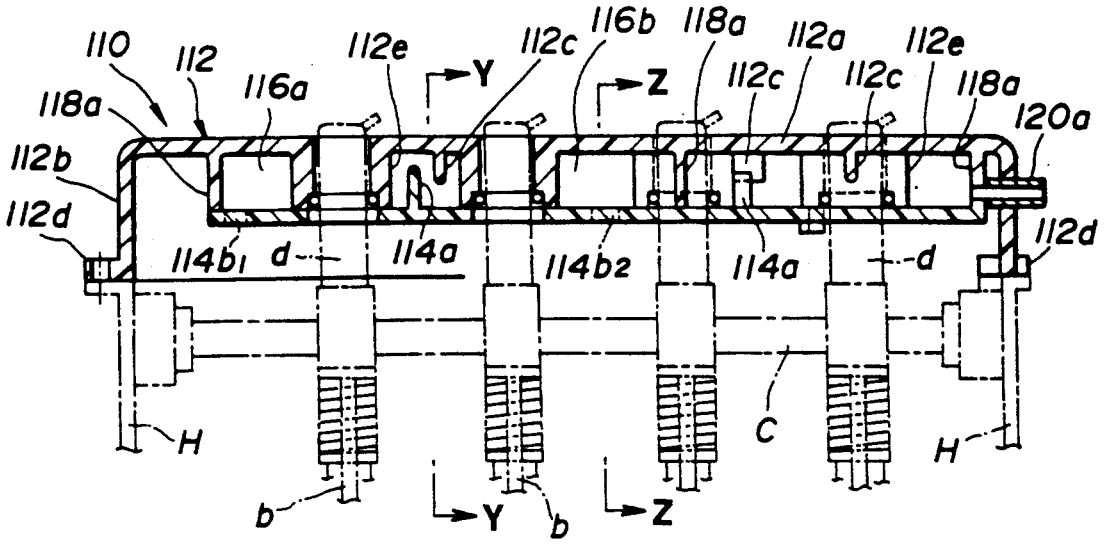
FIG. 4 is a view similar to FIG. 1 but shows another embodiment.
Figure 5:
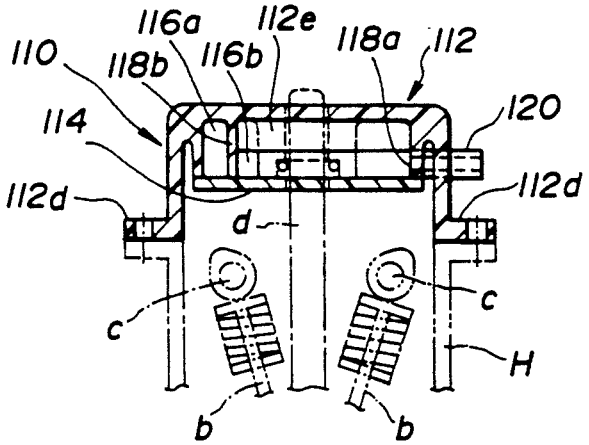
FIG. 5 is a sectional view taken along the line Y—Y of FIG. 4.
Figure 6:
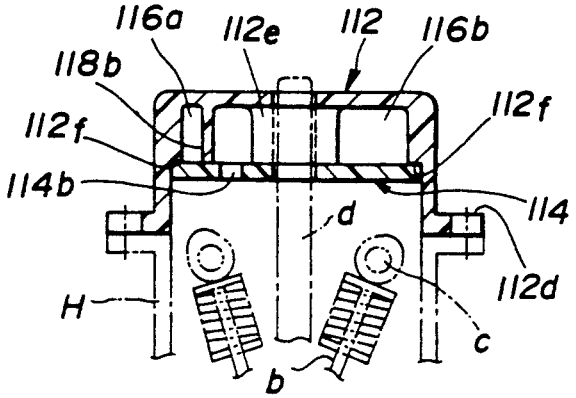
FIG. 6 is a sectional view taken along the line Z—Z of FIG. 4.

Referring to FIGS. 1 to 3, a plastic rocker cover of this invention is generally designated by 10 and shown as being installed on a cylinder head "H" to cover a valve operating mechanism "M" consisting of rocker arms "a", valves "b", a camshaft "c", etc.

The rocker cover 10 consists of an outer cover member 12 which is hollow rectangular parallelepiped, i.e., of a rectangular box-like shape and an inner partition member 14 which is in the form of a rectangular plate which is generally planar. The outer cover member 12 and the partition member 14 cooperate to define therebetween an oil gas separating chamber 16 as will be described more in detail hereinbelow. The outer cover member 12 and the inner partition member 14 are made of the same synthetic resinous material such as polyamid, polyacetal, etc. The cover member 12 has a rectangular top wall 12*a* and and a side wall or peripheral wall 12*b* in the form of a rectangular ring or tube. The peripheral wall 12*b* has at the lower end thereof a plurality of flanged portions 12*d* so that the outer cover member 12 is bolted at the flanged portions 12*d* to the cylinder head "H". The top wall 12*a* has on an inside surface thereof a plurality of downward barrier-like projections 12*c* which are arranged in line and in predetermined intervals in the direction of flow of blow-by gases, i.e., in the lengthwise direction of the rocker cover 10. The inner partition member 14 is provided with a plurality of upward barrier-like projections 14*a* which are respectively arranged between an adjacent two of the barrier-like projections 12*c* of the outer cover member 12. In other words, the downward and upward barrier-like projections 12*c* and 14*a* are arranged alternately in the lengthwise direction of the rocker cover 11 in such a manner as to form a zig-zag blow by passage for promoting separation of oil from blow-by gases when blow-by gases are drawn to flow through the oil-gas separating chamber 16. The inner partition wall member 14 has at one lengthwise end an inlet opening 14*b* and at an opposite lengthwise end a drain opening 14*c*. The outer cover member 12 is provided with an outlet pipe 20 which is secured to a lengthwise end portion of the top wall 12*a* adjacent to the drain opening 14*c*.

The outer cover member 12 has a buffer wall 18 in the form of a rectangular ring or tube disposed inside of the peripheral wall 12*b* and depending from the top wall 12*a* in such a manner as to provide a small clearance "t" between the peripheral wall 12*b* and the buffer wall 18. The buffer wall 18 is integral with the outer cover member 12 and is so formed as to have a sufficient resilience or flexibility. The partition member 14 is secured by supersonic welding, heat bonding, or the like to a lower free end of the buffer wall 18.

In operation, on the intake stroke, blow by gases in the crankcase (not shown) are drawn by vacuum through the cylinder head "H" and the inlet opening 14*b* of the partition member 14 into the oil-gas separating chamber 16. The blow-by gases are then drawn to flow through the zig zag blow-by passage in the oil-gas separating chamber 16, i.e., flow while being caused to change its flow direction upwardly and downwardly alternately due to the provisions of the downward and upward barrier-like projections 12*c* and 14*a* so that oil is separated from the blow by gases. The blow-by gases from which oil has been removed in the above manner are then drawn out of the oil gas separating chamber 16 through the outlet pipe 20 and supplied to the intake manifold of the engine, whilst the oil separated from the blow-by gases is returned to the oil pan (not shown) through the drain opening 14*c*.

The inner partition member 14 is heated to expand when the engine is running and cooled to contract when the engine is off. However, since the inner partition member 14 is not directly secured to the peripheral wall 12*b* of the cover member 12 but secured to the top wall 12*a* by way of the buffer wall 18, thermal expansion and contraction of the partition wall member 14 can cause only resilient deformation of the buffer wall 18 and can not cause any influence on the outer cover member 12, i.e., thermal expansion and contraction of the partition member 14 is offset or absorbed by resilient deformation of the buffer wall 18.

Thermal contraction of the partition member 14 is also caused at low atmospheric temperatures. However, such thermal contraction can also be absorbed by resilient deformation of the buffer wall 18. Contraction of the partition member 14 further occurs due to its crystallization. Such contraction can also be absorbed by resilient deformation of the buffer wall 18. The outer cover member 12 is assuredly prevented from being acted upon by the stresses resulting from expansion and contraction of the partition wall member 14, and particularly at peripheral wall portions near the flanged portions 12*d* is assuredly prevented from being doubly acted upon by the stresses resulting from tightening with bolts and the stresses resulting from expansion and contraction of the partition member 14.

In the meantime, the rocker cover 10 according to the above described embodiment is adapted for adoption to an engine of the type having spark plugs (not shown) for installation on the side portions of the cylinder head "H" and the single camshaft "c" for driving a pair of valves "b" for each cylinder.

Referring to FIGS. 4 to 8, a rocker cover according to another embodiment of this invention is designated by 110 and adapted for adoption to an engine of the type having spark plugs each disposed at a central portion of a cylinder (i.e., a so-called central ignition type) and a pair of camshafts "c" for driving a pair of valves "b" for each cylinder. The rocker cover 110 consists of an outer cover member 112 and an inner partition member 114.

The outer cover member 112 is in the form of an elongated dish having a nearly rectangular shape and made of a synthetic resinous material. The cover member 112 has a top wall 112*a* and a peripheral wall 112*b* The peripheral wall 112*b* has at a lower end of thereof a plurality of flanged portions 112*d* so that the cover member 112 is bolted at the flanged portions 112*d* to the cylinder head "H". The top wall 112*a*, as seen from FIGS. 4 to 7, has at an inside surface thereof a plurality of vertical bosses (four bosses in this embodiment) 112*e* depending therefrom and arranged in line in the lengthwise direction of the rocker cover 110. Each boss 112*e* is hollow and cylindrical so as to allow passage of a spark plug wrench "d" therethrough.

Figure 8:
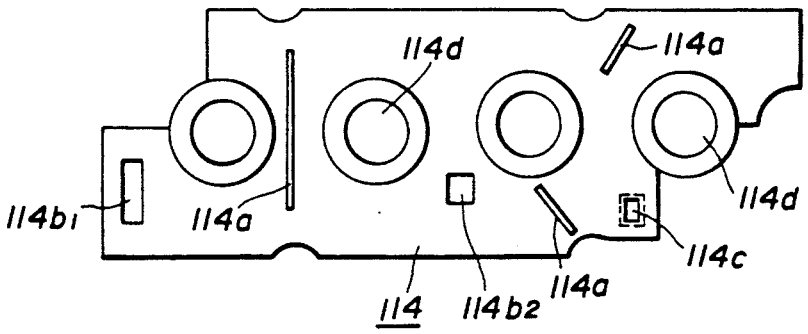
FIG. 8 is a top plan view of the inner partition wall member of the embodiment of FIG. 4.

The inner partition member 114, as seen from FIG. 8, is nearly rectangular, a little shorter in length and a little smaller in width than those of the inner periphery of the outer cover member 112*b*, and partially cut off at a pair of diagonally opposed corner portions. The partition member 114 has a plurality of holes 114*d* for allowing passage of the spark plug wrench "d" therethrough and is brought into contact with the lower ends of the bosses 112*e* at the portions around the holes 114*d*.

The outer cover member 112 and the inner partition member 114 are adapted to define therebetween a first oil-gas separating chamber 116*a* and a second oil-gas separating chamber 116*b*. For this end, the peripheral wall 112*b* of the outer cover member 112 is formed with a pair of shoulder portions 112*f* at the same vertical position with the lower ends of the bosses 112*e* and elongated over the longer side edges of the partition member 114, respectively. On the other hand, the top wall 112*a* has at an inside surface thereof a plurality of downward, buffer walls 118*a* and 118*b* of the same height as the bosses 112*e*. The buffer walls 118*a* and 118*b* are formed integral with the top wall 112*a*. The buffer walls 118*a* extend mainly widthwise of the rocker cover 110 whilst the buffer walls 118*b* extend mainly lengthwise so as to serve as partitions for defining the first and second oil-gas separating chambers 116*a* and 116*b*. The buffer walls 118*a* adjacent to the opposite lengthwise ends of the cover member 112 are constructed and arranged so as to conform to the peripheral shapes of the opposite lengthwise ends of the partition wall member 114 and be spaced from the opposite lengthwise ends of the outer cover member 112, respectively. The buffer walls 118*b* adjacent to the flanged portions 112*d* are arranged apart from the peripheral wall 112*b* in such a manner as to provide a space "t" therebetween and continuously with the shoulder portions 112*f*. In other words, the shoulder portions 112*f* are partly spaced away from the peripheral wall 112*b* at locations adjacent to the flanged portions 112*d* so as to form the buffer walls 118*b*.

Figure 7:
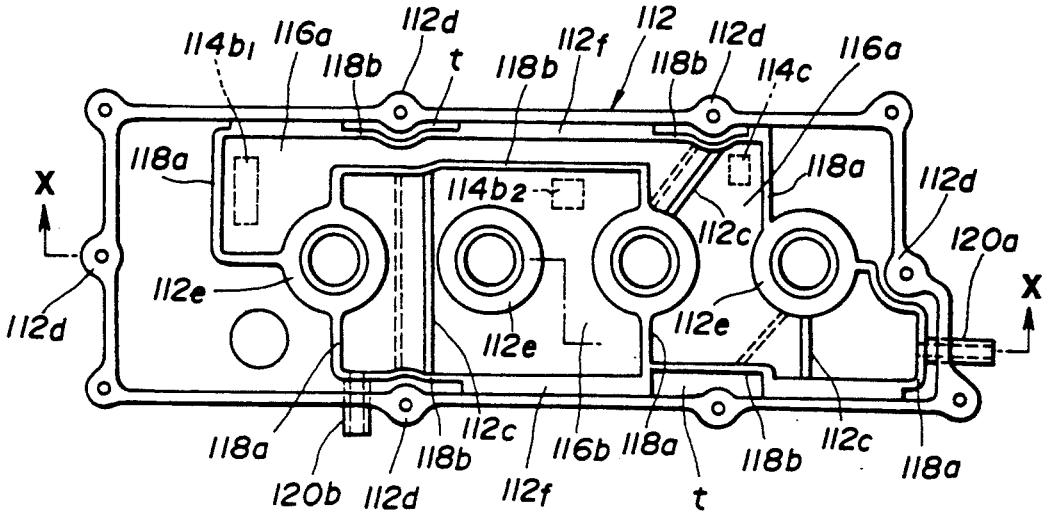
FIG. 7 is a bottom plan view of the outer cover member of the embodiment of FIG. 4.

As seen from FIG. 7, the first oil-gas separating chamber 116*a* is horizontally surrounded by one of the widthwise opposed side wall portions of the outer cover member 112, the buffer wall 118*a* extending between one of the above described widthwise opposed side wall portions of the outer cover member 112 and the first one of the bosses 112*e* from the left in the drawing, the buffer wall 118*a* extending between the above described widthwise opposed side wall portions of the cover member 112 by way of the fourth one of the bosses 112*e* from the left in the drawing, the other of the above described widthwise opposed side wall portions of the outer cover member 112, the buffer wall 118*a* extending between the third one of the bosses 112*e* from the left in the drawing and the other of the above described widthwise opposed side wall portions of the outer cover member 112, and the buffer wall 118*b* extending between the first one and the third one of the bosses 112*e* from the left in the drawing, whereby to be formed into a hook like shape. The first oil-gas separating chamber 116*a* is vertically closed by the top wall 112*a* of the outer cover member 112 and a horizontal wall portion of the partition member 114. A first inlet opening 114*b*1 is formed in the partition wall member 114 in such a manner as to be located in the left-hand end of the first oil-gas separating chamber 116*a*. A barrier-like projection 112*c* depending from the top wall 112*a* of the outer cover member 112 projects into the first oil-gas separating chamber 116*a*. A first outlet pipe 120*a* is connected to the right-hand end of the first oil-gas separating chamber 116*a*.

The second oil gas separating chamber 116*b* is horizontally surrounded by the other of the above described widthwise opposed side wall portions of the outer cover member 112, the buffer walls 118*a* and 118*b* extending between the first one of the bosses 112*e* from the left in the drawing and the other of the above described widthwise opposed side wall portions of the outer cover member 112, the buffer wall 118*a* extending between the third one of the bosses 112*e* from the left in the drawing and the other of the above described widthwise opposed side wall portions of the outer cover member 112 and the buffer wall 118*b* extending between the first one and the third one of the bosses 112*e* from the left in the drawing, whereby to be formed into a rectangular shape. The second oil-gas separating chamber 116*b* is vertically closed by the top wall 112*a* of the outer cover member 112 and the horizontal wall portion of the partition member 114. A second inlet opening 114*b*2 is formed in the partition member 114 in such a way as to be connected to the right-hand part of the second oil separating chamber 116*b*. A barrier-like projection 112*c* depending from the top wall 112*a* protrudes into the second separating chamber 116*b*. A second outlet pipe 120*b* is provided which protrudes through the other of the above described widthwise opposed side wall portions of the outer cover member 112 to be connected to the left-hand part of the second oil-gas separating chamber 116*b*.

The partition wall member 114 is formed with a drain opening 114*c* at a right-hand end portion and a plurality of barrier-like projections 114*a* protruding upward into the first and second oil separating chambers 116*a* and 116*b* so as to cooperate with the barrier like projections 112*c* depending from the top wall 112*a* of the outer cover member 112 to define therebetween zig-zag blow by gas passages, respectively. The partition member 114 is secured to the lower ends of the buffer walls 118*a* and 118*b*, shoulder portions 112*f* and the lower end of the bosses 112*e* by supersonic welding, heat bonding, etc.

In operation, the blow-by gases produced in the engine are drawn partly into the first oil-gas separating chamber 116*a* through the first inlet opening 114*b*1 and partly into the second oil gas separating chamber 116*b* through the second inlet opening 114*b*2. During passage through the first and blow-by gases are forced to strike against the downward and upward barrier-like projections 112*c* and 114*a* and change in the direction of flow, whereby to cause oil particles contained in the blow-by gasses to be separated therefrom. The blow-by gases from which oil has been removed are then drawn our of the oil-gas separating chambers 116*a* and 116*b* through the outlet pipes 120*a* and 120*b* and supplied to the intake manifold (not shown) of the engine. The separated oil in the first oil-gas separating chamber 116*a* is returned to the oil pan (not shown) through the first inlet opening 114*b*1, whilst the separated oil in the second oil gas separating chamber 116*b* is returned to the oil pan through the drain opening 114*c*. The partition member 114 is heated to expand during running of the engine and cooled to contract when the engine is off after running. However, since the partition member 114 is secured to the buffer walls 118*a* and 118*b* spaced from the adjacent side wall portions of the outer cover member 112, such expansion and contraction of the partition wall member 114 does not cause any substantial influence to the flanged side wall portions of the outer cover member 112 such that the side wall portions adjacent to the flanged portions 112*d* are assuredly prevented from being doubly acted upon by the stresses resulting from the tightening of bolts and the stresses resulting from the above described thermal expansion and contraction of the inner partition member 114 and therefore assuredly prevented from breakage such as cracking. Similar effect is attained in case of contraction of the inner partition member 114 due to its crystallization or due to a low atmospheric temperature.

From the foregoing, it will be understood that a plastic rocker cover of this invention is provided with a plurality of resiliently deformable buffer walls spaced inward from the cover member side wall or peripheral wall portions adjacent to flanged portions where the rocker cover is bolted to a cylinder head, and an inner partition member secured to the lower ends of the buffer walls such that expansion and contraction of the inner partition member can be offset or absorbed by resilient deformation of the buffer walls for thereby preventing damage or breakage of the outer cover member, thus enabling the rocker cover to be durable for an elongated period of usage.

What is claimed is:

1. A plastic rocker cover comprising:

an outer cover member made of a synthetic resinous material and having a top wall and a peripheral wall;

an inner partition member made of a synthetic resinous material and disposed inside of said outer cover member to cooperate with said top wall and said peripheral wall to define therebetween an oil-gas separating chamber;

said peripheral wall of said outer cover member having flanged portions at which it is to be bolted and shoulder portions for attaching thereto said partition member; and buffer wall means for absorbing expansion and contraction of said partition member whilst defining part of said oil-gas separating chamber;

said buffer wall means including resiliently deformable buffer walls integral with said top wall and forming part of said shoulder portions, said buffer walls depending from said top wall in such a manner as to be spaced inward from said flanged peripheral wall portions;

said partition member being secured to lower ends of said buffer walls.

2. A plastic rocker cover according to claim 1, wherein said outer cover member is elongated so that said peripheral wall has opposite lengthwise side wall portions, said buffer wall means further includes resiliently deformable buffer walls integral with said top wall and depending therefrom in such a manner as to be spaced inward from said opposite lengthwise side wall portions of said outer cover member, and said partition member is secured to lower ends of said buffer walls.

3. A plastic rocker cover according to claim 2, wherein said outer cover member has a plurality of integral bosses depending from said top wall and arranged in line in a lengthwise direction of said outer cover, said bosses being hollow for allowing passage of a spark plug wrench therethrough, said partition member being in the form of a generally planar plate and having a plurality of holes for passage of said spark plug wrench therethrough, said partition member being secured at locations around said holes to lower ends of said bosses.

4. A plastic rocker cover comprising:

an outer cover member made of a synthetic resinous material and having a top wall and a peripheral wall;

an inner partition member made of a synthetic resinous material and disposed inside of said outer cover member to cooperate with said top wall and said peripheral wall to define therebetween an oil-gas separating chamber;

said peripheral wall of said outer cover member having flanged portions at which it is to be bolted; and buffer wall means for absorbing expansion and contraction of said partition member whilst defining part of said oil-gas separating chamber;

said buffer wall means including resiliently deformable buffer walls integral with said top wall and depending therefrom in such a manner as to be spaced inward from said flanged peripheral wall portions;

wherein said outer cover member is elongated so that said peripheral wall has opposite lengthwise side wall portions, said buffer wall means further includes resiliently deformable buffer walls integral with said top wall and depending therefrom in such a manner as to be spaced inward from said opposite lengthwise side wall portions of said outer cover member, and said partition member is secured to lower ends of said buffer walls;

wherein said outer cover member has a plurality of integral bosses depending from said top wall and arranged in line in a lengthwise direction of said outer cover, said bosses being hollow for allowing passage of a spark plug wrench therethrough, said partition member being in the form of a generally planar plate and having a plurality of holes for passage of said spark plug wrench therethrough, said partition member being secured at locations around said holes to lower ends of said bosses; and wherein said buffer wall means further includes a resiliently deformable buffer wall integral with said top wall of said outer cover member and depending therefrom whilst extending lengthwise of said outer cover member between a predetermined two of said bosses, thereby separating said oil-gas separating chamber into first and second chamber sections, said first and second chamber sections each having a blow-by gas inlet and a blow-by gas outlet.

5. A plastic rocker cover according to claim 4, wherein said partition member has a drain opening for one of said chamber sections, one of said blow-by gas inlet for the other of said chamber sections being adapted to serve as a drain opening.

6. A plastic rocker cover according to claim 5, wherein said top wall of said outer cover member and said partition member are respectively provided with downward and upward barrier-like projections which form within said chamber sections zig-zag blow-by gas passages.

* * * * *